United States Patent [19]

Dills

[11] 4,188,520

[45] Feb. 12, 1980

[54] EFFECTIVE CONCURRENT MICROWAVE HEATING AND ELECTRICAL RESISTANCE HEATING IN A COUNTERTOP MICROWAVE OVEN

[75] Inventor: Raymond L. Dills, Louisville, Ky.

[73] Assignee: General Electric Company, Louisville, Ky.

[21] Appl. No.: 911,555

[22] Filed: May 31, 1978

[51] Int. Cl.[2] ..... H05B 9/06

[52] U.S. Cl. ..... 219/10.55 B; 219/10.55 R; 219/486; 307/41

[58] Field of Search ..... 219/10.55 B, 10.55 E, 219/10.55 R, 484, 485, 486, 492, 493; 323/23, 25; 307/38, 39, 40, 41; 328/70

[56] References Cited

U.S. PATENT DOCUMENTS

| | | | |
|---|---|---|---|
| 3,028,472 | 4/1962 | Baird | 219/10.55 B |
| 3,081,392 | 3/1963 | Warner | 219/10.55 B |
| 3,457,430 | 7/1969 | Samuelson | 307/41 |
| 3,523,170 | 8/1970 | Boehm | 219/10.55 B |
| 3,569,656 | 3/1971 | White et al. | 219/10.55 B |
| 3,717,300 | 2/1973 | Evalds | 219/486 |
| 3,767,894 | 10/1973 | Berger | 219/485 |
| 4,020,358 | 4/1977 | Wyland | 307/39 |

FOREIGN PATENT DOCUMENTS

| | | | |
|---|---|---|---|
| 2315208 | 10/1973 | Fed. Rep. of Germany | 307/40 |

*Primary Examiner*—Bruce A. Reynolds
*Assistant Examiner*—Philip H. Leung
*Attorney, Agent, or Firm*—Bernard J. Lacomis; Radford M. Reams

[57] ABSTRACT

In a cooking oven supplied from a power source of limited capability, a time ratio control system alternately energizes a microwave energy generating system and an electrical resistance heating element a plurality of times during each cooking operation to, in effect, time share the available power. The resultant concurrent microwave and electrical resistance provides improved cooking results when the power source capability is limited.

8 Claims, 5 Drawing Figures

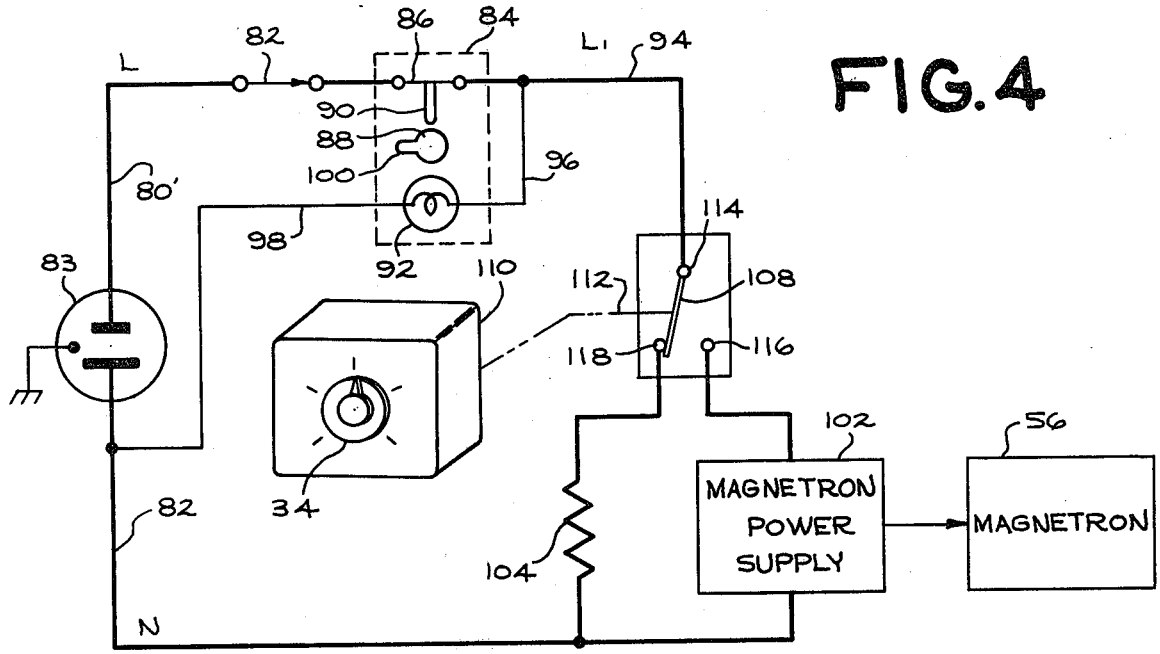
FIG. 4
FIG. 5
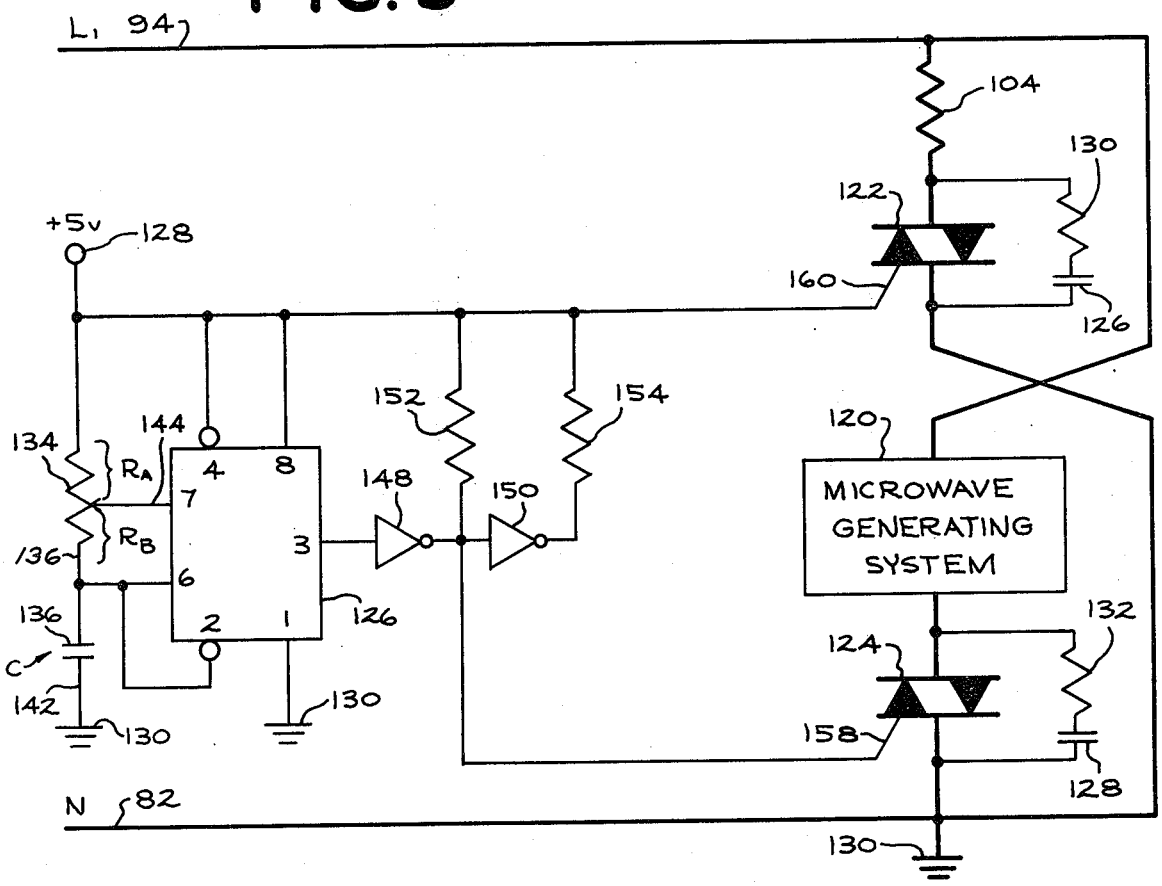

EFFECTIVE CONCURRENT MICROWAVE HEATING AND ELECTRICAL RESISTANCE HEATING IN A COUNTERTOP MICROWAVE OVEN

CROSS REFERENCE TO RELATED APPLICATIONS

Improvements and specific embodiments of this invention are the subject matter of commonly-assigned copending applications Ser. No. 911615, filed May 31, 1978, by Bohdan Hurko and Thomas R. Payne, and entitled "Effective Time Ratio Browning in a Microwave Oven Employing High Thermal Mass Browning Unit;" and Ser. No. 911614, filed May 31, 1978, by Thomas R. Payne, and entitled "Optimum Time Ratio Control System for Microwave Oven Including Food Surface Browning Capability."

BACKGROUND OF THE INVENTION

The present invention relates generally to microwave ovens including supplementary electrical resistance heating capability and, more particularly, to such an oven which is adapted for operation from a power source insufficient to supply both the microwave and the electrical resistance heating capabilities simultaneously at their respective full rated power levels.

Ovens employing microwave energy to rapidly cook food have come into widespread use in recent years. While microwave cooking generally has the advantage of being faster than conventional cooking, it has long been recognized that conventional cooking is superior in certain respects. In particular, for some types of food, microwave cooking is considered unsatisfactory by many people for the reason that there is usually only a slight surface browning effect, especially where a relatively short cooking time is employed. Additionally, foods such as steaks, chops, or the like, of relatively small thickness, are often more satisfactorily cooked when rested on a plate heated sufficiently to cause searing. Similarly, foods which are cooked in relatively shallow metal utensils, such as frozen dinners, are more advantageously cooked when the metal utensile itself is heated.

To realize the benefits of both methods, a number of combination microwave and conventional cooking ovens have been proposed and commercially produced. These ovens, as their name implies, combine in a single cavity the capability of microwave cooking and conventional cooking by electrical resistance heating. The microwave cooking capability is provided by a microwave energy source such as a magnetron which produces cooking microwaves when energized from a suitable high voltage DC source. Means for providing conventional cooking capability may take any one of a number of forms including sheathed electrical resistance heating elements, commonly called broil and bake elements, at the top and bottom of the cooking cavity respectively; heaters applied to utensil-supporting plates; and forced convection designs which include a fan for circulating air past a heating element and then across the food.

Several of these designs have proven to be quite satisfactory in operation and commercially successful. They are typically full-size combination conventional and microwave ovens operated from a 240 volt power source with a current-supplying capability which, for practical purposes, is unlimited. Therefore, simple switching schemes may be employed to alternately energize either the microwave cooking capability, the conventional cooking capability, or both capabilities simultaneously. Many thousands of watts of power are available from the power source, and this is sufficient to heat a domestic sized cooking oven in any manner desired.

More recently, so-called countertop microwave ovens have been introduced. These ovens typically have a somewhat smaller cooking cavity compared to a full-size conventional oven and are designed for operation from a 115 volt, 15 amp household branch circuit. To meet UL requirements, an appliance designed for operation from such a power source is limited to a maximum requirement of 13.5 amperes. This corresponds to approximately 1550 watts. As explained next, this limited power souce capability results in some particular problems.

A typical microwave energy generating system intended for a countertop microwave oven requires a major portion of this available power. Such a typical system comprises a magnetron which produces between 500 and 600 watts of output power at a frequency of 2450 MHz, and a suitable power supply for the magnetron. A typical microwave energy generating system has an energy conversion efficiency in the order of 50%. In addition to the microwave energy generating system, a practical microwave oven includes a number of low power load devices such as lamps, motors, and control circuitry. Altogether, one particular commercially-produced countertop microwave oven model draws approximately 11.2 RMS amps from a 115 volt line for microwave cooking alone. This corresponds to approximately 1300 watts.

In addition, supplementary electrical resistance heating units, for effective operation, should be operated at approximately 1200 to 1400 watts. This is particularly so for infrared food surface browning. For effective and reasonably rapid browning, the watts density over the area covered by a supplementary electrical resistance browning element should be approximately 20 watts per square inch. With 1200 watts of available browning power, approximately 60 square inches could be covered by radiation from such a browning element. Even 60 square inches is a relatively small area, and any decrease in available browner power would reduce the covered area even further. As a result, where a browner unit is provided, substantially all of the limited available power should be supplied to the browning unit.

Therefore, for an oven designed for operation from a 115 volt, 15 amp household branch circuit, as a practical matter the limited power available precludes the simultaneous energization of the microwave energy generating system and the supplementary electrical resistance heating units at their respective full rated power levels.

In answer to this practical limitation on available power, countertop microwave ovens intended for operation from a power source insufficient to supply both the microwave and electrical resistance browning capabilities simultaneously at their respective full rated power levels have resorted to a two-step cooking procedure whereby cooking by microwave energy is accomplished first, with the electrical resistance browning element de-energized. Next the microwave source is de-energized and the electrical resistance browning element is energized for the remainder of the cooking cycle.

As an alternative to a separate electrically energized heating element for browning or the like, a number of special utensils have been proposed and commercially produced to effect browning when used in a microwave oven. These utensils comprise an element, for example a thin resistive film applied to an undersurface of the utensil, which element has the capability of absorbing some of the microwave energy available in the cooking cavity and converting the same to heat. The utensil itself becomes elevated to a sufficiently high temperature for browning or searing. In a similar vein, devices have been proposed which alter the electromagnetic energy within the cooking cavity so as to produce near field dielectric heating for improved surface browning. It will be appreciated that, while such utensils are beneficial with certain foods, the microwave energy they absorb is then unavailable for direct heating of the food. Additionally, they are not as efficient as direct electrical resistance heating because the less-than-100% energy conversion efficiency of the microwave energy generating system must be taken into account.

While not directly related to browning, an important feature included in many microwave ovens is a variable microwave power level control. Variable power level control provides flexibility in cooking various types of food, including thawing frozen foods at a reduced power level. One particular power level control scheme which is employed in microwave ovens is duty cycle power level control whereby the microwave energy source is pulsed from full OFF to full ON repetitively, with the duty cycle under control of the user of the oven. In this way, the time averaged rate of heating can be effectively controlled. The repetition period may vary from in the order of one second for fully electronic duty cycle power level controllers, to in the order of thirty seconds for electromechanical cam operated duty cycle power level controllers.

SUMMARY OF THE INVENTION

Accordingly, it is an object of the invention to provide a cooking oven having both microwave and electrical resistance heating capability, which is adapted for operation from a power source insufficient to supply both the microwave and electrical resistance heating capabilities simultaneously at the respective full rated power levels, but wherein effective microwave and electrical resistance heating can be accomplished concurrently without exceeding the power source capability.

It is another object of the invention to provide such a cooking oven which provides better cooking results than the two-step sequential microwave cooking and browning method previously employed.

Briefly stated and in accordance with one aspect of the invention, these and other objects are accomplished by a cooking oven which includes a microwave energy generating system and an electrical resistance heating element. A time ratio control system alternately energizes the microwave energy generating system and the electrical resistance heating element a plurality of times during each cooking operation to, in effect, time share the available power. At all times, the power required remains within the capability of the power source. Actual cooking tests have shown that this gives superior results when compared to the two-step cooking process. One reason for the superior results is that during those periods when the microwave energy source is de-energized and the electrical resistance heating system is energized, the temperature throughout the body of the food being heated is given time to equalize. As is known, many microwave cooking ovens do not have perfectly uniform microwave energy distribution within the cavity, and as a result hot spots and colt spots within the body of food are produced. A common microwave cooking technique is to allow a waiting or "equalization" period during which heat flows from warmer to cooler regions within the body of food. When the time sharing concept is employed, gradual equalization occurs at a number of times during the cooking cycle. Less time is required for final equalization at the end of a cooking operation, and more importantly short term temperature differentials are minimized so that the presence of slightly overcooked regions is minimized.

When the electrical resistance heating element is a radiant (infrared) food surface browning unit, another benefit of the time sharing approach, cosmetic in nature, is apparent when a user observes the food while it is cooking. During conventional cooking, food gradually browns throughout the cooking process. However, with the prior art two-step cooking process employed with microwave oven browner systems, browning does not occur until near the end. With time sharing, browning progress more nearly resembles that which occurs during conventional cooking, and the result is visually more pleasing than the "two-step" approach.

Where relatively short duty cycles are employed, it is preferable that the electrical resistance heating element have a relatively low thermal mass. For example, resistive film heaters and infrared quartz lamps have been found to be effective. In the case of a resistive film heater, the heater may be applied to a plate-like shelf for supporting cooking utensils for directly heating the shelf.

BRIEF DESCRIPTION OF THE DRAWINGS

While the novel features of the invention are set forth with particularity in the appended claims, the invention, both as to organization and content, will be better understood and appreciated, along with other objects and features thereof, from the following detailed description taken in conjunction with the drawings, in which:

FIG. 4 is a simplified electrical circuit schematic diagram showing a general means for alternately energizing a magnetron for generating microwave cooking energy and an electrical resistance heating element; and FIG. 5 is a schematic diagram showing a more specific electrical circuit for controlling a microwave generating system and an electrical resistance heating element.

DESCRIPTION OF THE PREFERRED EMBODIMENTS

Figure 1:
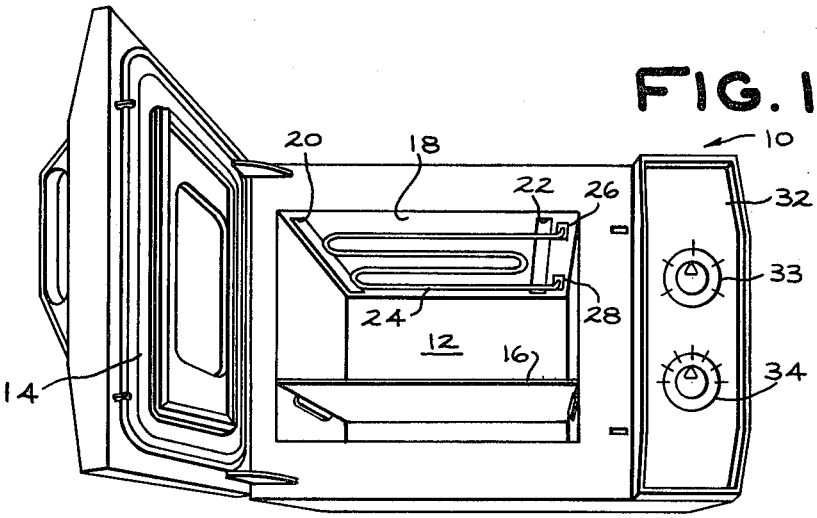
FIG. 1 is a front perspective view of a countertop microwave oven with the door open and a serpentine sheathed electrical resistance heating element located at the top of the cooking cavity.

Referring first to FIG. 1, there is shown a countertop microwave oven 10 including a cooking cavity generally designated 12 and an access door 14 for closing the cooking cavity 12. For supporting food or utensils placed in the oven, a shelf 16 of dielectric sheet material is provided near the bottom of the cooking cavity 12.

For coupling microwave energy into the cavity 12, the top wall 18 of the cavity 12 includes a pair of apertures 20 and 22 which couple microwave energy from a waveguide system (not shown) supplied by a magnetron (not shown) into the cavity 12. It will be appreciated that the microwave feed system illustrated is exemplary only and does not form any part of the present invention. As another example, instead of the pair of apertures 20 and 22, a single, larger, centrally located aperture covered by a suitable heat resistant plate (not shown) which is transparent to microwave energy might be employed.

For food surface browning, an electrical resistance browning element 24 is positioned within the cavity 12 so as to brown by radiant heat energy the surface of food being cooked therein. More specifically, the browning element 24 is a sheathed electrical resistance heating unit of serpentine configuration positioned generally adjacent to but spaced from the top wall 18 of the cooking cavity 12. The ends 26 and 28 of the browning element 24 are suitably terminated at the top wall 18, the electrical leads (not shown) therefrom being connected to circuitry (FIGS. 4 and 5) within an electrical components compartment located generally to the right of the cooking cavity 12.

A control panel 32 generally to the right of the cooking cavity 12 and forming the front of the aforementioned component compartment includes an upper control knob 33 to enable a user of the oven to select the total duration of a cooking operation. The duration of a cooking operation may be selected by the control knob 33 to range from as little as a minute or less, up to an hour or more, depending upon the particular food being cooked. Alternatively, the duration of a cooking operation need not be precisely determined as a function of time, but instead may be selected to end when the interior temperature of the food being cooked has reached a predetermined temperature representing a desired degree of doneness. This may be accomplished for example by employing a temperature sensing probe and circuit such as is disclosed in U.S. Pat. Nos. 3,975,720-Chen and Fitzmayer 3,991,615-Hornung, and 4,035,787-Hornung, the entire disclosures of which are hereby incorporated by reference.

The control panel 32 also includes an apportionment control 34 which may be employed by a user to apportion the available power between the microwave energy generating system and the food surface browning system. Specifically, the apportionment control 34 functions to control the time ratio between the energization of the microwave energy source and the energization of the browning element 24.

Figure 2:
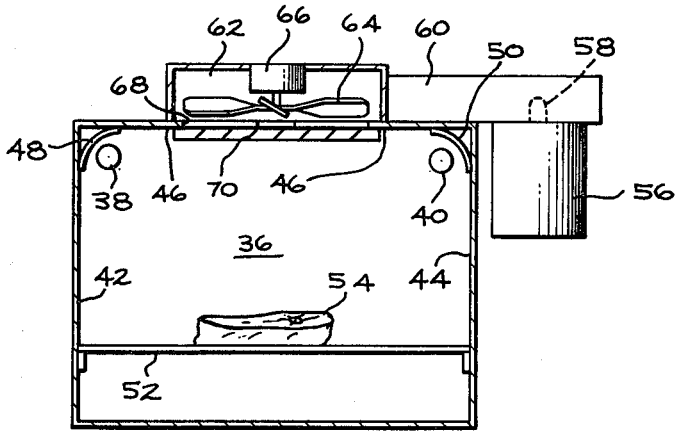
FIG. 2 is a front elevational view of a microwave oven cooking cavity including an extended tubular infrared quartz lamp extending along the interfaces between either side of the cooking cavity and the top wall of the cooking cavity.

Referring next to FIG. 2 there is shown a front elevational view of a cooking cavity 36 of a microwave oven including another form of electrical resistance heating element. Specifically, a pair of tubular infrared quartz lamps 38 and 40 extend generally along the interfaces between the left and right sidewalls 42 and 44 with the top wall 46. Preferably, to reflect microwave energy away from the actual walls of the cooking cavity 36 and towards the center of the cavity 36, a pair of curved reflectors 48 and 50 are positioned behind the quartz lamps 38 and 40 between the lamps and the corners of the cavity. Additionally, a dielectric shelf 52 similar to the shelf 16 of FIG. 1 supports a foodstuff 54 which is to be browned and cooked.

To provide microwave cooking capability a magnetron 56 has its output element 58 coupled to a waveguide 60 feeding a mode stirrer cavity 62. To provide more uniform microwave energy distribution, a slowly rotating, fan-like mode stirrer 64 is positioned within the cavity 62 and rotated by a motor 66. Microwave energy is coupled into the cooking cavity 36 through an aperture 68 which, for protection, is covered by a plate 70 of a material transparent to microwave energy.

For clarity of illustration, FIG. 2 omits various other conventional microwave oven components, including a power supply for the magnetron 56 and other necessary electrical connections.

Figure 3:
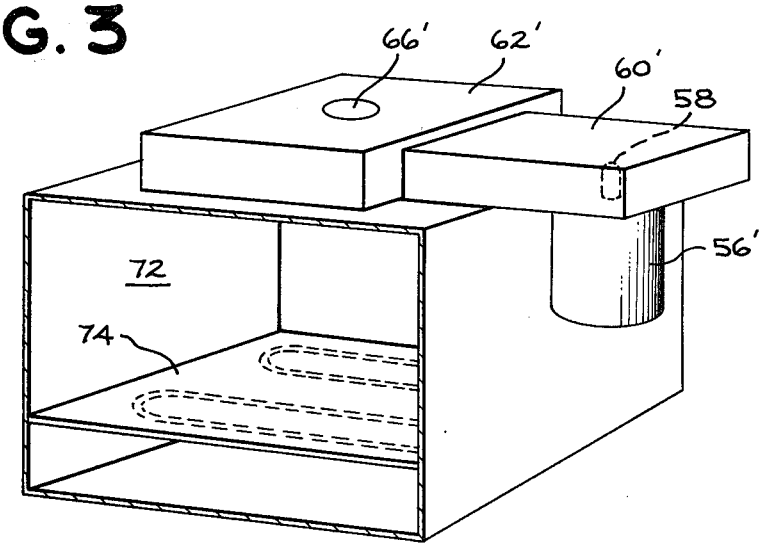
FIG. 3 is a perspective view of a microwave oven including a plate-like shelf for supporting cooking utensils and a resistive film heater applied to the shelf.

Referring now to FIG. 3, there is illustrated a cooking cavity 72 adapted for energization by microwave energy and including still another form of electrical resistance heating element. Those components of the FIG. 3 oven which comprise the capability for microwave cooking may be identical to those described above with reference to FIG. 2. Accordingly, these microwave components are designated by primed reference numerals and will not be further described.

Within the cooking cavity 72 of FIG. 3 there is positioned a plate-like shelf 74 for supporting cooking utensils and located near the bottom of the cooking cavity 72. The particular electrical resistance element of FIG. 3 is a resistive film heater 76 applied to the underside of the shelf 74 to effect direct heating thereof. Many such heaters are known in the art and may comprise either a precious metal or a tin oxide film. Resistive film heaters may be formed either by deposition in selected areas, or by etching away selected portions of a film which initially substantially covers all of one side of the plate-like shelf 74. As in the case of the infrared quartz lamps 38 and 40 of FIG. 2, the film resistance heater 76 of FIG. 3 has relatively low thermal mass and therefore heats up fairly rapidly.

The embodiment of FIG. 3 is particularly suitable where it is desired to cook frozen dinners or the like which are supplied in relatively shallow aluminum cooking utensils, whereby microwave heating may be accomplished from the top, and electrical resistance heating, applied to the utensil itself, from the bottom.

Referring now to FIG. 4, there is shown an electrical block diagram of a system for operating any of the ovens of FIGS. 1,2 or 3 to accomplish effective microwave and electrical resistance heating substantially simultaneously without exceeding the power source capability. The circuit 78 of FIG. 4 includes L and N power source terminals 80 and 82, respectively, supplied by a standard 115 volt, 15 amp plug 83 intended for connection to a household branch circuit, insufficient to supply both the microwave and electrical resistance heating capabilities simultaneously at their respective full rated power levels.

Interposed in series with the L conductor 80 is a switch 82 which is representative of several switches and relay contacts conventionally employed in microwave ovens. For example, typically there is a main power switch or relay and also various safety interlock switches which serve, for example, to prevent operation unless the door 14 is closed.

In order to establish the total overall time duration of a cooking operation, a cooking timer 84 is provided, as indicated by a highly schematic representation thereof. The representative timer 84 comprises a cam operated switch 86 operated by a rotating cam 88 through a link 90. A timing motor 92 drives the rotating cam 88. The switch 86 is connected in the L conductor 80 in series with the switch 82 so as to energize an L' line 94 when closed as illustrated. The leads 96 and 98 of the timing motor are connected to the L' line 94 and the N line 82, respectively. By means of a suitable connection (not shown) to the control knob 33 (FIG. 1), the duration established by the timer 84 is user variable according to the type of food being cooked, and can range from less than a minute to an hour or more.

While the highly schematic timer 84 is illustrated, it will be appreciated that many types of cooking timers are possible, including fully electronic timers. Moreover, as mentioned above, the total overall time duration of a cooking operation may not actually be specified by the user of the oven as a function of time, but might instead be established by a food temperature sensing probe and suitable circuitry to sense when the interior temperature of the food being cooked has reached a desired degree of doneness.

In the operation of the timer 84, the user control 33 positions the cam 88 to a desired starting position, the exact starting position depending upon the length of cooking time desired. The cam 88 then rotates until eventually the protrusion 100 contacts the link 90 to open the switch 86. At this point power to the L' line 94 is interrupted, terminating the cooking operation.

For microwave cooking, the magnetron 56 and a magnetron power supply 102 are shown in block diagram form. The magnetron power supply 102 when supplied from 115 volts AC at approximately 12 amps generates an appropriate high DC voltage to energize the magnetron 56. The power supply 102 and the magnetron 56 thus together comprise a microwave energy generating system. Additionally, an electrical resistance heating element 104 of approximately 1200–1400 watts rating at 115 volts is shown. The electrical resistance heating element 104 is representative of either the sheathed electrical resistance heating element 24 of FIG. 1, the tubular infrared quartz lamps 38 and 40 together of FIG. 2, or the resistive film heater 76 of FIG. 3.

Additionally, there is schematically illustrated a single-pole, double-throw controlled switching element 108 operatively driven by a time ratio control 110, the operative connection represented by a dash line 112. The controlled switching element 108 and the time ratio control 110 together comprise a duty cycle control switching means for alternately energizing the magnetron power supply 102 and thus the magnetron 56 and the electrical resistance heating element 104 a plurality of times during each cooking operation. More specifically, the magnetron power supply 102 and the resistance heating element 104 each have a neutral return to the N power source conductor 82. The L' power conductor 94 is connected to a common switch terminal 114. One switch terminal 116 is connected to the magnetron power supply 102, and the other switch terminal 118 is connected to the other terminal of the resistance heating element 104.

In operation as directed by the control time ratio control 110, the controlled switching element 108 alternately connects the L power source terminal 80 to the magnetron power supply 84 and the resistance heating element 86.

It will be seen that the face of the representative time ratio control 110 includes the apportionment control 34, and suitable indicia to indicate relative apportionment between microwave power and resistance heating power on a time-averaged basis.

The characteristics of the time ratio control 110 are such that the microwave energy generating system and the heating element 104 are energized a plurality of times during each cooking operation. Depending upon the precise control, the repetition period may be anywhere from less than a minute up to several minutes. It will be appreciated that the time ratio control 110 is shown in highly generalized form in FIG. 4, and may take many different forms. One particular form is described hereinafter with particular reference to FIG. 5. Another exemplary form is a so-called infinite heat switch, commonly employed to control electric range surface units on a duty cycle basis. Such an infinite heat switch could be modified to provide the required double throw output, or could be used to energize the coil of a double throw relay.

Alternatively, the time ratio control 110 and the controlled switching element 108 may be viewed as a variable duty cycle power level control means for periodically energizing the magnetron power supply 102 and thus the magnetron 56 from the power source connected to the L and N conductors 80 and 82. Energization of the magnetron power supply 102 and the magnetron 56 is accomplished through the common switch terminal 114 and the switch terminal 116. The provision of the other switch terminal 118 connected to the resistance heating element 86 then further comprises a means for energizing the electrical resistance heating element 104 during those periods when the microwave energy generating device system comprising the magnetron power supply 102 and the magnetron 56 is not energized.

Referring now to FIG. 5, there is shown a schematic diagram of a specific implementation which may be generally employed as the time ratio control 110 and controlled switching element 108 of FIG. 4. In FIG. 5, the resistance heating element 104 and a microwave generating system 120 are each connected between the L' conductor 94 and the N conductor 82 through individual controlled switching elements in the form of triacs 122 and 124. When the corresponding triac 122 or 124 is gated, either the heating element 104 or the microwave generating system 120 is energized. For each of the triacs 122 and 124, a protective network comprising a series capacitor 126 or 128 and a resistor 130 or 132 is connected across the main triac terminals.

The microwave generating system 120 is preferably a conventional one comprising a permanent magnet magnetron supplied by a half wave doubler power supply including a ferroresonant transformer as the power supply input element.

Control circuitry which supplies suitable gating signals to the triacs 122 and 124 to alternatively energize the heating element 104 and the microwave generating system 120 comprises a fixed period, variable duty cycle square wave oscillator comprising an astable multivibrator built around a "555" monolithic timer IC 126. Pin numbers shown for the timer IC 126 are those for an 8 pin, dual inline package (DIP). A conventional power supply (not shown) supplies +5 volts DC to a supply terminal 128 referenced to a circuit reference point 130, which is also connected to the N power source conductor 82. Power for the power supply may be derived through suitable connections (not shown) to the L' and N conductors 94 and 82.

The positive DC supply Pin 8 of the IC 126 is connected to the supply terminal 128, and the IC ground Pin 1 is connected to the circuit reference point 130. The reset Pin 4 is unused and is thus tied to the positive supply terminal 128. Pin 3 is the output of the IC 96. A user variable potentiometer 134 mechanically connected for operation by the apportionment control 34, and a timing capacitor 136 are serially connected and together determine the period and duty cycle of the timer. The upper terminal of the potentiometer 134 is connected to the DC supply terminal 98, and the lower terminal 136 of the potentiometer 134 is connected to sensing Pins 6 and 2 of the IC timer 136, in addition to the capacitor 136. The lower capacitor terminal 142 is connected to the reference point 130. To complete the timer circuit, the movable potentiometer contact 144 is connected to the discharge PIn 7 of the timer IC 96.

As an aid to understanding the operation of the timer, the resistance of that portion of the potentiometer 134 which is above the movable contact 144 is designated $R_A$. The resistance of that portion of the potentiometer 134 which is below the movable contact 144 is designated $R_B$. The value of the timing capacitor 136 is designated C.

In operation, the "555" IC 126, through its Pins 2 and 6, senses the voltage on the timing capacitor 136. Depending upon the voltage so sensed, the "555" IC either open circuits the discharge Pin 7, or internally grounds Pin 7. When Pin 7 is open, the capacitor 136 charges through the resistances $R_A$ and $R_B$ toward the potential at the positive DC supply terminal 128. When the voltage on the capacitor 136 reaches two thirds of the DC supply voltage, as sensed by Pin 6, the discharge Pin 7 goes low and the capacitor 136 discharges through the resistance $R_B$. When the capacitor 136 voltage falls to one third of the DC supply voltage, as sensed by Pin 2, the discharge Pin 7 again floats, to continue the oscillation cycle.

To provide an output at the same time, the internal arrangement of the IC 96 is such that the output Pin 3 is high when the discharge Pin 7 is open and the capacitor 136 is charging, and the output Pin 3 is low when the discharge Pin 7 is low and the capacitor 136 is discharging. As a result, the $(R_A+R_B)C$ time constant determines the length of the interval when the output Pin 3 is high, and the $R_{BC}$ time constant determines the interval when the output Pin 3 is low. By moving the position of the potentiometer movable contact 144 through operation of the apportionment control 34, the user of the oven varies the ratio of the time intervals during which the output Pin 3 is high and low, thereby varying the ultimate duty cycles of the heating element 104 and the microwave generating system 120 through further connections hereinafter described.

Considering now the output connection of the "555" IC timer 126, the output Pin 3 is connected through a pair of buffers in the form of TTL inverters 148 and 150. To provide sufficient output current capability, each of the inverters 148 and 150 may comprise several parallel TTL inverters. A pair of pull up resistors 152 and 154 connect the outputs of the inverters 148 and 150 to the positive DC supply terminal 128.

Finally, to energize the microwave generating system 120 when the output Pin 3 is low, the output of the first inverter 148 is connected to the gate lead 158 of the triac 124. To energize the electrical resistance heating element 104 when the output Pin 3 is high, the output of the second inverter 150 is connected to the gate lead 160 of the triac 122.

The following Table lists component values which are believed to be suitable in the circuits described herein. It will be appreciated that these components values as well as the circuits themselves are exemplary only and are provided to enable the practice of the invention with a minimum amount of experimentation.

TABLE

| | |
|---|---|
| Resistors | |
| 104 | 1200 watt electrical resistance heating unit, 11 ohms |
| 130 | 150 ohm |
| 132 | 150 ohm |
| 134 | 1 Meg ohm potentiometer |
| 152 | 120 ohm |
| 154 | 120 ohm |
| Capacitors | |
| 125 | 0.1 mfd. |
| 128 | 0.1 mfd. |
| 136 | 200 mfd. |
| Semiconductor Devices | |
| 122 | G.E. SC160DX4 Triac |
| 124 | G.E. SC160DX4 Triac |
| 126 | Monolithic integrated circuit timer, Signetics NE555, Motorola MC1555, or equivalent |
| 148 | 3 parallel Texas Instruments type SN7404 TTL inverters |
| 150 | 3 parallel Texas Instruments type SN7404 TTL inverters |

It will be apparent therefore that the present invention provides a means for providing substantially concurrent microwave and electrical resistance heating without exceeding the capability of a power source which is insufficient to supply both the microwave and electrical resistance heating capabilities at their respective full rated power levels.

While specific embodiments of the invention have been illustrated and described herein, it is realized that modifications and changes will occur to those skilled in the art. It is therefore to be understood that the appended claims are intended to cover all such modifications and changes as fall within the true spirit and scope of the invention.

What is claimed is:

1. A cooking oven having both microwave and electrical resistance heating capabilities, which is adapted for operation from a power source insufficient to supply both the microwave and electrical resistance heating capabilities simultaneously at their respective full rated power levels, and wherein effective microwave and electrical resistance heating can be accomplished concurrently without exceeding the power source capability, said oven comprising:

means for establishing the overall duration of a cooking operation;

a microwave energy generating system;

an electrical resistance heating element;

duty cycle power control means for periodically energizing said microwave energy generating system from the power source, said microwave energy generating system being energized a plurality of times during each cooking operation; and means for energizing said electrical resistance heating element only during those periods when said microwave energy generating system is not energized.

2. An oven according to claim 1, wherein said electrical resistance heating element has a relatively low thermal mass.

3. An oven according to claim 2, wherein said electrical resistance heating element is a resistive film heater.

4. An oven according to claim 3, which further comprises a plate-like shelf for supporting cooking utensil and wherein said resistive film heater is applied to said shelf.

5. A cooking oven having both microwave and electrical resistance heating capabilities, which is adapted for operation from a power source insufficient to supply both the microwave and electrical resistance heating capabilities simultaneously at their respective full rated power levels, and wherein effective microwave and electrical resistance heating can be accomplished concurrently without exceeding the power source capability, said oven comprising:

means for establishing the overall duration of a cooking operation;

a microwave energy generating system;

an electrical resistance heating element;

a duty cycle controlled switching means for alternately energizing said microwave energy generating system and said electrical resistance heating element a plurality of times during each cooking operation, said switching means operative to permit energization of said resistance heating element only when said microwave energy generating system is not energized.

6. An oven according to claim 5, wherein said electrical resistance heating element has a relatively low thermal mass.

7. An oven according to claim 6, wherein said electrical resistance heating element is a resistive film heater.

8. An oven according to claim 7, which further comprises a plate-like shelf for supporting cooking utensils and wherein said resistive film heater is applied to said shelf.

* * * * *